US010913169B2

(12) United States Patent
Hayashi et al.

(10) Patent No.: US 10,913,169 B2
(45) Date of Patent: Feb. 9, 2021

(54) RECIPROCATING-TYPE ELECTRIC SHAVER

(71) Applicant: Izumi Products Company, Matsumoto (JP)

(72) Inventors: Kenya Hayashi, Matsumoto (JP); Tetsuhiko Shimizu, Matsumoto (JP)

(73) Assignee: MAXELL IZUMI CO., LTD., Matsumoto (JP)

( * ) Notice: Subject to any disclaimer, the term of this patent is extended or adjusted under 35 U.S.C. 154(b) by 83 days.

(21) Appl. No.: 15/943,994

(22) Filed: Apr. 3, 2018

(65) Prior Publication Data

US 2018/0319026 A1 Nov. 8, 2018

(30) Foreign Application Priority Data

May 2, 2017 (JP) ..... 2017-091541

(51) Int. Cl.
*B26B 19/04* (2006.01)
*B26B 19/28* (2006.01)
(Continued)

(52) U.S. Cl.
CPC ..... *B26B 19/046* (2013.01); *B26B 19/102* (2013.01); *B26B 19/28* (2013.01);
(Continued)

(58) Field of Classification Search
CPC ..... B26B 19/04; B26B 19/044; B26B 19/046; B26B 19/12; B26B 19/28; B26B 19/288;
(Continued)

(56) References Cited

U.S. PATENT DOCUMENTS 2,287,337 A * 6/1942 Zimmermann ..... B26B 19/28 30/43.92
2,979,819 A * 4/1961 Kleinman ..... B26B 19/04 30/43.91
(Continued)

FOREIGN PATENT DOCUMENTS

DE 4418644 A1 12/1994
DE 19736776 A1 3/1999
(Continued)

OTHER PUBLICATIONS

The extended European search report of corresponding EP application No. 18169913.3 dated Sep. 17, 2018.
(Continued)

*Primary Examiner* — Evan H MacFarlane
(74) *Attorney, Agent, or Firm* — Muncy, Geissler, Olds & Lowe, P.C.

(57) ABSTRACT

A reciprocating-type electric shaver includes an outer blade, an oscillator that is driven to reciprocate by a motor, and an inner blade that reciprocates in cooperation with the oscillator. The oscillator includes attachment portions that are respectively attached to a main body, a movable base, both end sides of which are supported by the attachment portions via support portions having a substantially U-shape, and a cooperation portion that cooperates with the inner blade. In the respective support portions, a portion on a side connected to the attachment portion in a base portion, which is one linear portion of the U-shape, is formed in flexible oscillating pieces. The respective oscillating pieces are formed to be tilted in a direction orthogonal to a reciprocating direction of the movable base so that a lower portion side of the respective oscillating pieces is open outward in the reciprocating direction of the movable base.

3 Claims, 8 Drawing Sheets

(51) Int. Cl.
*B26B 19/10* (2006.01)
*B26B 19/38* (2006.01)

(52) U.S. Cl.
CPC ..... *B26B 19/288* (2013.01); *B26B 19/3846* (2013.01); *B26B 19/3853* (2013.01)

(58) Field of Classification Search
CPC ..... B26B 19/3846; B26B 19/3853; B26B 19/102
See application file for complete search history.

(56) References Cited

U.S. PATENT DOCUMENTS 3,365,796 A * 1/1968 Demci ..... B26B 19/28 30/43.92
3,399,454 A * 9/1968 Liska ..... B26B 19/04 30/43.92
3,714,711 A * 2/1973 Daniels ..... B26B 19/28 30/43.92
4,030,573 A * 6/1977 Buzzi ..... A45D 29/14 188/380
4,312,126 A * 1/1982 Rochelt ..... B26B 19/02 30/43.92
4,367,658 A * 1/1983 Rochelt ..... B06B 1/10 74/110
4,570,499 A * 2/1986 Durr ..... B26B 19/28 30/43.91
4,805,300 A * 2/1989 Miska ..... B26B 19/04 30/34.1
5,050,300 A * 9/1991 Miska ..... B26B 19/28 30/34.1
5,325,590 A * 7/1994 Andis ..... B26B 19/28 30/216
5,632,087 A * 5/1997 Motohashi ..... B26B 19/282 30/43.9
6,226,871 B1 * 5/2001 Eichhorn ..... B26B 19/048 30/346.51
7,334,338 B2 * 2/2008 Shiba ..... B26B 19/04 30/346.51
7,965,000 B2 * 6/2011 Komori ..... H02K 33/16 310/15
9,729,023 B2 * 8/2017 Komori ..... B26B 19/3866
2014/0020253 A1 * 1/2014 Gilbert ..... B26B 19/28 30/215
2018/0085950 A1 * 3/2018 Fischer ..... B26B 19/06
2018/0311841 A1 * 11/2018 Kraus ..... B26B 19/048

FOREIGN PATENT DOCUMENTS

DE 102006010323 A1 9/2007
EP 2404716 A1 1/2012
JP H08-173650 A 7/1996
JP 2006-149445 A 6/2006

OTHER PUBLICATIONS

An Office Action for the corresponding JP patent application No. 2017-091541 dated Oct. 6, 2020 and English translation thereof.

* cited by examiner

X=direction orthogonal to the reciprocating direction

RECIPROCATING-TYPE ELECTRIC SHAVER

CROSS-REFERENCE TO RELATED APPLICATION

This application is based upon and claims the benefit of priority of the prior Japanese Patent Application No. P2017-091541, filed on May 2, 2017, and the entire contents of which are incorporated herein by reference.

TECHNICAL FIELD

The present invention relates to a reciprocating-type electric shaver.

BACKGROUND ART

A reciprocating-type electric shaver is known in which an inner blade reciprocates while coming into sliding contact with an inner surface of an outer blade having a substantially inverted U-shape in a side view so that an inner blade cuts hair entering slits disposed in the outer blade (for example, refer to PTL 1: JP-A-2006-149445). Examples of the hairs include beards, mustaches, whiskers, and the like.

As illustrated in FIG. 7, the reciprocating-type electric shaver 10 disclosed in PTL 1 includes an outer blade 11, an oscillator 14 which is driven to reciprocate by a motor 13 inside a main body 12, and an inner blade 15 which reciprocates while coming into sliding contact with an inner surface of the outer blade 11 in cooperation with the oscillator 14. As illustrated in FIG. 8, the oscillator 14 includes attachment portions 16*a*, 16*b* which are respectively located at both end sides and attached to the main body 12, a movable base 18 which is located between both the attachment portions 16*a*, 16*b*, both end sides of which are supported by the attachment portions 16*a*, 16*b* via support portions 17*a*, 17*b* respectively having a substantially U-shape in a front view, and which is driven to reciprocate by the motor 13 in a state where the movable base 18 is suspended from the attachment portions 16*a*, 16*b* by the support portions 17*a*, 17*b*, and a cooperation portion 19 which protrudes from the movable base 18 and cooperates with the inner blade 15.

SUMMARY OF INVENTION

Technical Problem

In driving the inner blade of the reciprocating-type electric shaver, driving speed for causing the inner blade in the related art to reciprocate (rotation speed of the motor) is mainly set to approximately 8,000 rpm. However, in recent years, the inner blade tends to be rotated at higher rotation speed of approximately 10,000 rpm.

However, if the rotation speed increases while maintaining a structure in the related art as illustrated in FIG. 7, the support portions 17*a*, 17*b* having a substantially U-shape of a movable component (oscillator 14) cannot fully respond to the rotation speed, and a waving phenomenon occurs in thin oscillating pieces 17*aa*, 17*bb* thereof (refer to FIGS. 9 and 10). In this regard, it is understood that the waving phenomenon leads to premature failure.

That is, in the support portions 17*a*, 17*b* having a substantially U-shape of the oscillator 14, a portion on the attachment portion 16 side serving as one linear portion of the U-shape is formed in thin flexible oscillating pieces

17*aa*, 17*bb*. The oscillating pieces 17*aa*, 17*bb* are formed to be thin in this way. Accordingly, if the oscillator 14 is driven to reciprocate at high speed of approximately 10,000 rpm, it is understood that a waving phenomenon as illustrated in FIG. 9 occurs in the oscillating pieces 17*aa*, 17*bb* located on a rear side in a moving direction of the movable base 18. On the other hand, it is understood that a waving phenomenon as illustrated in FIG. 10 occurs in the oscillating pieces 17*aa*, 17*bb* located on a front side in the moving direction of the movable base 18.

Solution to Problem

The present invention is made in order to solve the above-described problem, and aims to provide a reciprocating-type electric shaver which has excellent durability by suppressing a waving phenomenon of an oscillating piece of an oscillator.

In order to achieve the above-described object, the present invention includes the following configurations.

That is, according to an aspect of the present invention, there is provided a reciprocating-type electric shaver including outer blades, oscillators that are driven to reciprocate by a motor installed inside a main body, and an inner blade that reciprocates while coming into sliding contact with an inner surface of the outer blades in cooperation with the oscillator. The oscillators include attachment portions that are located on both end sides, and that are respectively attached to the main body, movable bases that are located between both the attachment portions, both end sides of which are supported by the attachment portions via support portions having a substantially U-shape in a front view, and that are driven to reciprocate by the motor in a state of being suspended from the attachment portions by the support portions, and cooperation portions that protrude from the movable bases, and that cooperate with the inner blade. In the respective support portions having the substantially U-shape in the oscillators, a portion on a side connected to the attachment portions in a base portion, which is one linear portion of the U-shape, is formed in flexible oscillating pieces. At a stationary position of the movable bases, the respective oscillating pieces are formed to be tilted in a direction orthogonal to a reciprocating direction of the movable bases so that a lower portion side of the respective oscillating pieces is open outward in the reciprocating direction of the movable bases.

In the reciprocating-type electric shaver, at the stationary position of the movable bases, the respective oscillating pieces may be tilted in the direction orthogonal to a reciprocating direction of the movable bases so that the lower portion side is open outward in the reciprocating direction of the movable bases at the same tilting angle within an angular range of 0.5° to 15°.

In the reciprocating-type electric shaver, at the stationary position of the movable bases, each tilting angle of the respective oscillating pieces may be set so that each outermost end of the respective oscillating pieces is located outward from a position orthogonal to the reciprocating direction of the movable bases as far as a distance longer than ½ of a maximum reciprocating distance of the movable bases.

Advantageous Effects of Invention

According to the aspect of the present invention, it is possible to provide a reciprocating-type electric shaver which shows satisfactory shaving performance and excellent durability by suppressing a waving phenomenon of an oscillating piece of an oscillator.

DESCRIPTION OF EMBODIMENTS

Hereinafter, a preferred embodiment according to the present invention will be described in detail with reference to the accompanying drawings.

Figure 1:
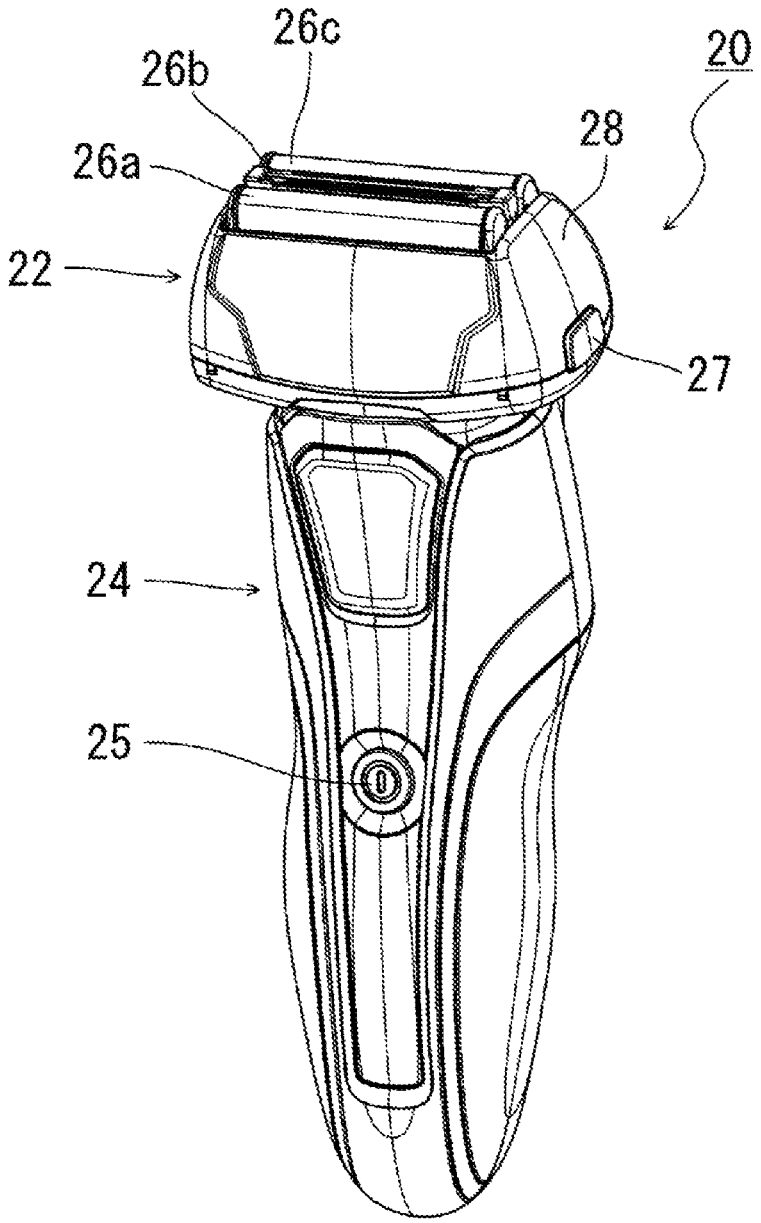
FIG. 1 is a perspective view of a reciprocating-type electric shaver.
Figure 2:
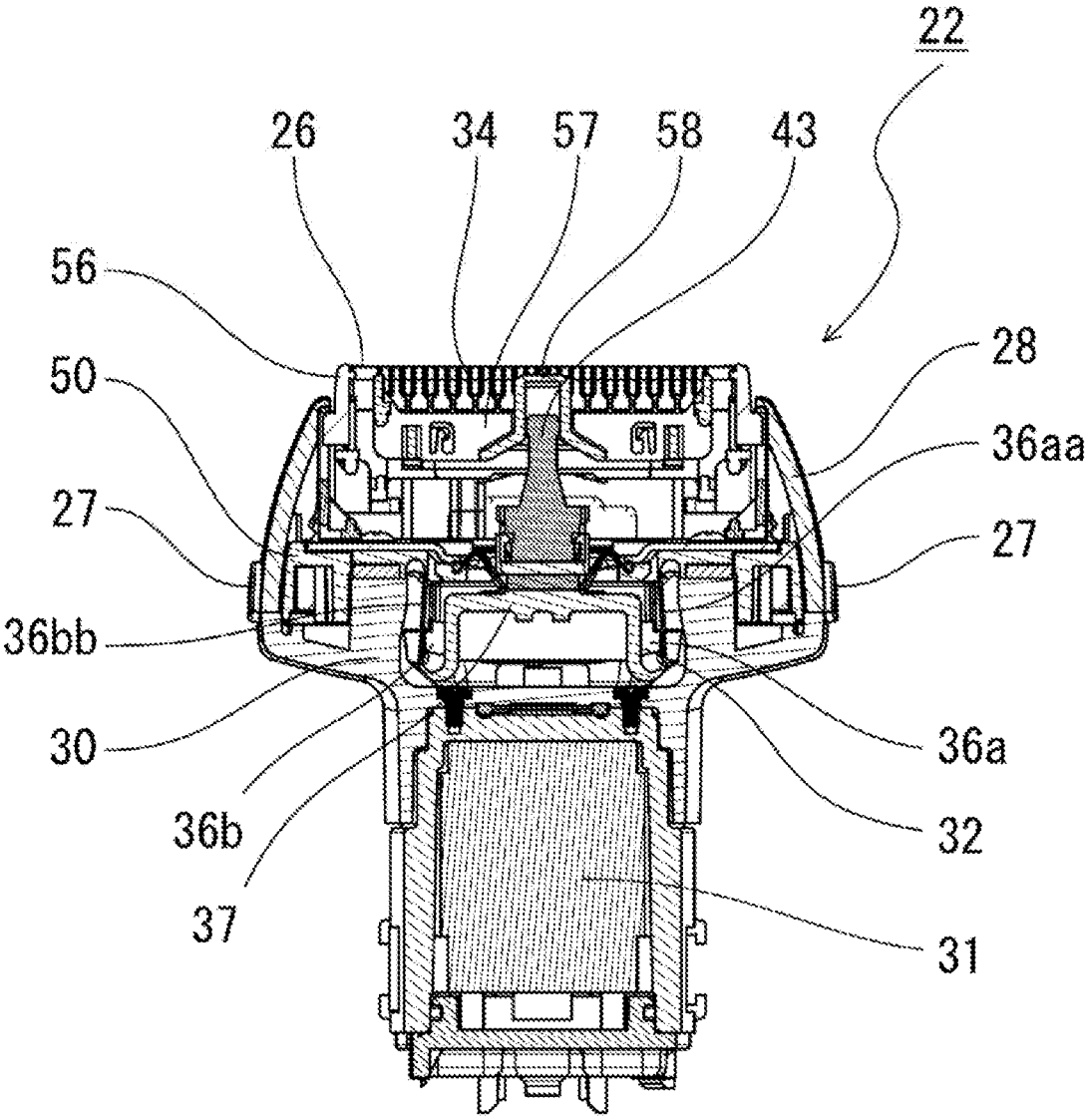
FIG. 2 is an illustrative sectional view of an inner blade drive portion.
Figure 3:
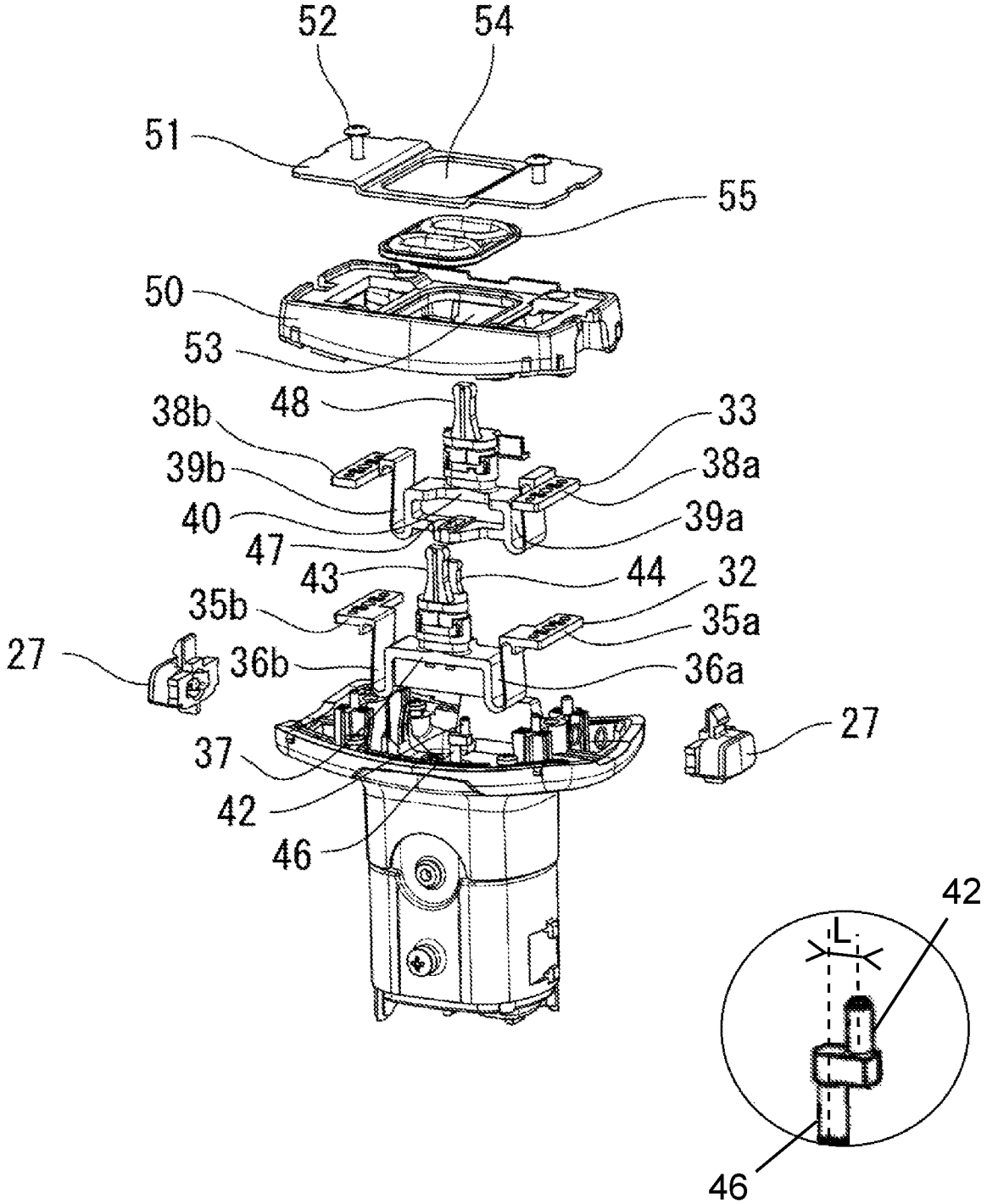
FIG. 3 is an assembly view of the inner blade drive portion.

FIG. 1 is a perspective view of a reciprocating-type electric shaver 20. FIG. 2 is an illustrative sectional view of an inner blade drive portion. FIG. 3 is an assembly view of the inner blade drive portion.

An overall configuration of the reciprocating-type electric shaver 20 may employ any known configuration except for an oscillator. Accordingly, the overall configuration will be briefly described below.

In FIG. 1, the reference numeral 22 represents a head, the reference numeral 24 represents a grip portion, and the reference numeral 25 represents a drive switch.

In the present embodiment, the head 22 includes triple outer blades 26*a*, 26*b*, 26*c* in one row.

A detachable button 27 is pushed, thereby enabling a cover 28 of the head 22 together with an outer blade 26 to be removed from the grip portion 24 side. An inner blade and an upper portion of a drive portion thereof are exposed, thereby enabling component replacement and cleaning.

As illustrated in FIGS. 2 and 3, a motor 31 and two oscillators 32, 33 are incorporated into a main body 30 of the grip portion 24.

The oscillator 32 is driven to reciprocate inner blades 34 (only one of the inner blades 34 is illustrated in FIG. 2) which respectively come into sliding contact with the outer blades 26*a*, 26*b* from the inside.

The oscillator 33 is driven to reciprocate the inner blade (not illustrated) which comes into sliding contact with the outer blade 26*c* from the inside.

Both end sides of the oscillator 32 respectively have attachment portions 35*a*, 35*b* fixed to the main body 30 by using screws (not illustrated). In addition, a central portion of the oscillator 32 has a movable base 37 which is supported by the attachment portions 35*a*, 35*b* via support portions 36*a*, 36*b* having a substantially U-shape in a front view, and which is suspended from the attachment portions 35*a*, 35*b* by the supporting portions 36*a*, 36*b*.

Similarly, both end sides of the oscillator 33 respectively have attachment portions 38*a*, 38*b* fixed to the main body 30 by using screws (not illustrated). In addition, a central portion of the oscillator 33 has a movable base 40 which is supported by the attachment portions 38*a*, 38*b* via support portions 39*a*, 39*b* having a substantially U-shape in a front view, and which is suspended from the attachment portions 38*a*, 38*b* by the support portions 39*a*, 39*b*.

In the movable base 37 of the oscillator 32, a crank pin 42 disposed eccentrically from a rotary shaft (not illustrated) of the motor 31 is caused to reciprocate in a rightward-leftward direction in FIGS. 2 and 3 by a crank mechanism which enters an elongated hole (not illustrated) disposed in the movable base 37. Then, cooperation portions 43, 44 protruding from the movable base 37 cooperate with the corresponding inner blade 34 (only one illustrated), thereby causing both the inner blades to reciprocate while respectively coming into sliding contact with the outer blades 26*a*, 26*b*.

Similarly, in the movable base 40 of the oscillator 33, a crank pin 46 disposed eccentrically from the rotary shaft (not illustrated) of the motor 31 is caused to reciprocate in the rightward-leftward direction in FIGS. 2 and 3 by a crank mechanism which enters an elongated hole 47 disposed in the movable base 40. Then, a cooperation portion 48 protruding from the movable base 40 cooperates with the corresponding inner blade (not illustrated), thereby causing the inner blade to reciprocate while coming into sliding contact with the outer blade 26*c*.

The oscillator 32 and the oscillator 33 are arranged at positions displaced from each other in a plan view, and cause the corresponding inner blades to reciprocate.

In FIG. 3, the reference numeral 50 represents an upper case, which is fixed to the main body 30 by a screw 52 together with a presser plate 51.

In the upper case 50 and the presser plate 51, through-holes 53, 54 are respectively formed in a central portion thereof, and the cooperation portions 43, 44, 48 protrude upward after being inserted into the through-holes 53, 54.

The reference numeral 55 represents a seal packing which covers the through-holes 53, 54.

In FIG. 2, the reference numeral 56 represents an outer blade holding case, which holds the outer blades 26*a*, 26*b*, 26*c* from the inside, and in which the outer blades 26*a*, 26*b*, 26*c* are detachably attached to the cover 28.

The inner blade 34 is held by an inner blade holder 57, and comes into sliding contact with the respective outer blades 26*a*, 26*b*, 26*c* from the inside. In addition, the inner blade 34 is received by a spring (not illustrated), and is held in a sinkable manner together with the outer blades 26*a*, 26*b*, 26*c*. The respective cooperation portions 43, 44, 48 installed on the side of the oscillators 32, 33 cooperate with a locking portion 58 disposed in the inner blade holder 57.

Next, in accordance with the present invention, the oscillators 32, 33 will be described with reference to FIGS. 4 to 6.

In the present embodiment, the oscillators 32, 33 are integrally formed of a resin. The oscillators 32, 33 may be made of metal. The oscillators 32 and 33 are formed using the same structure. Accordingly, hereinafter, the oscillator 32 will be described as an example.

In the present embodiment, in the respective supporting portions 36*a*, 36*b* which form a substantially U-shape in a front view of the oscillator 32, a portion on a side connected to the respective attachment portions 35*a*, 35*b* in a base portion, which is one linear portion of the U-shape, is formed on flexible and relative thin oscillating pieces 36*aa*, 36*bb*. Then, in the present embodiment, at a stationary position of the movable base 37, the respective oscillating pieces 36*aa*, 36*bb* are formed to be tilted in a direction X orthogonal to a reciprocating direction of the movable base 37 so that a lower portion side (U-shaped bent portion side) is open outward in the reciprocating direction of the movable base 37.

Figure 4:
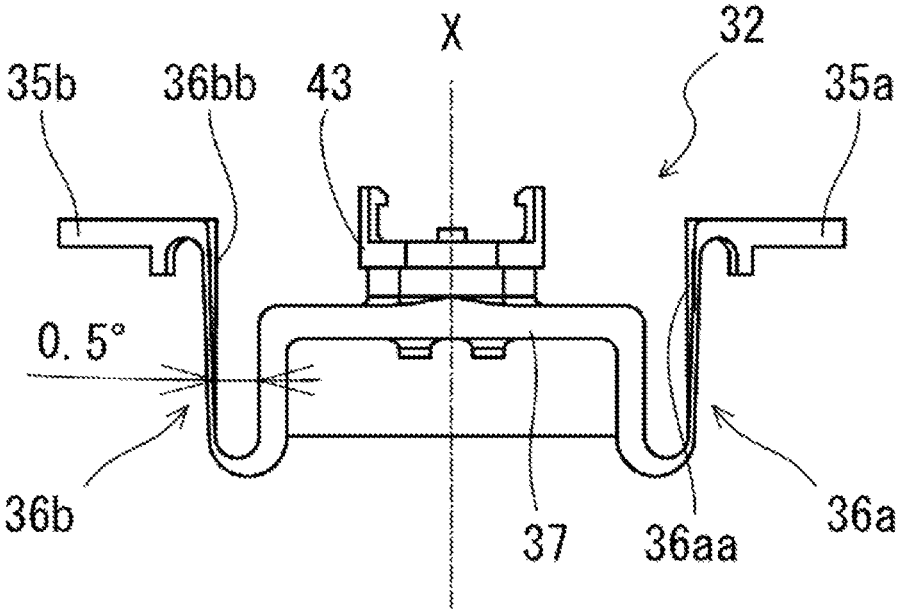
FIG. 4 is an illustrative view of an oscillator in a state where an oscillating piece is tilted as large as approximately 0.5°.

In an example illustrated in FIG. 4, the oscillating pieces 36*aa*, 36*bb* are disposed to be tilted in the direction X orthogonal to the reciprocating direction of the movable base 37 so that the lower portion side is open outward in the reciprocating direction of the movable base 37 at an angle of approximately 0.5°.

Figure 5:
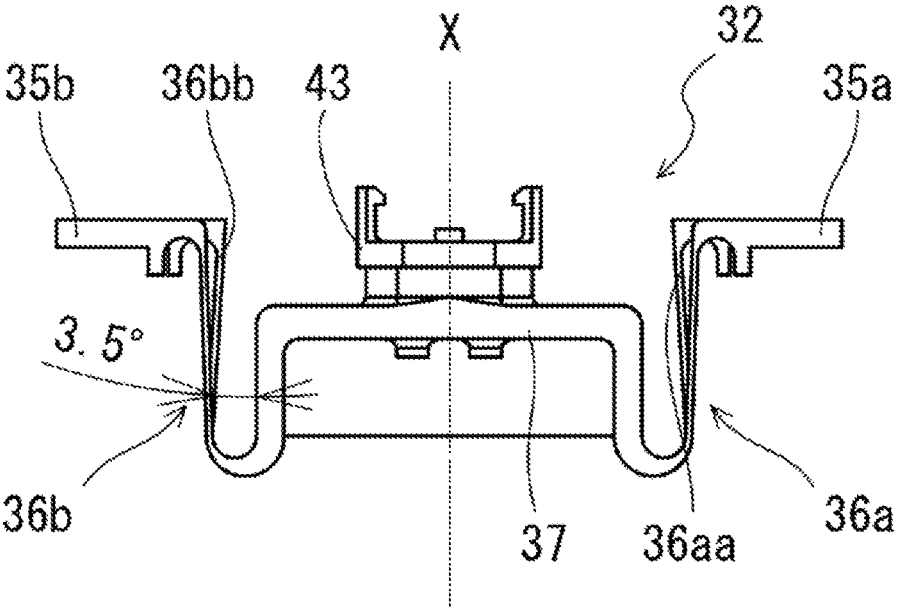
FIG. 5 is an illustrative view of the oscillator in a state where the oscillating piece is tilted as large as approximately 3.5°.

In an example illustrated in FIG. 5, the oscillating pieces 36*aa*, 36*bb* are disposed to be tilted in the direction X orthogonal to the reciprocating direction of the movable base 37 so that the lower portion side is open outward in the reciprocating direction of the movable base 37 at an angle of approximately 3.5°.

Figure 6:
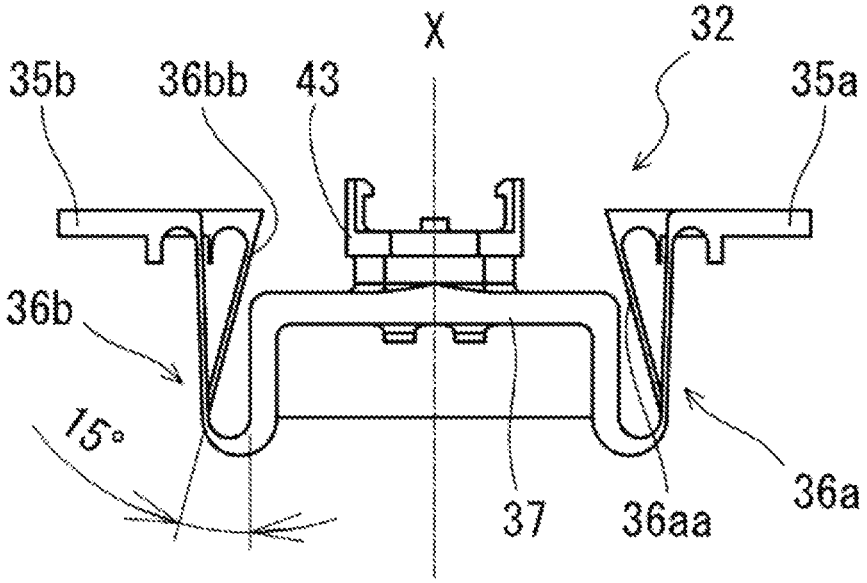
FIG. 6 is an illustrative view of the oscillator in a state where the oscillating piece is tilted as large as approximately 15°.
Figure 7:
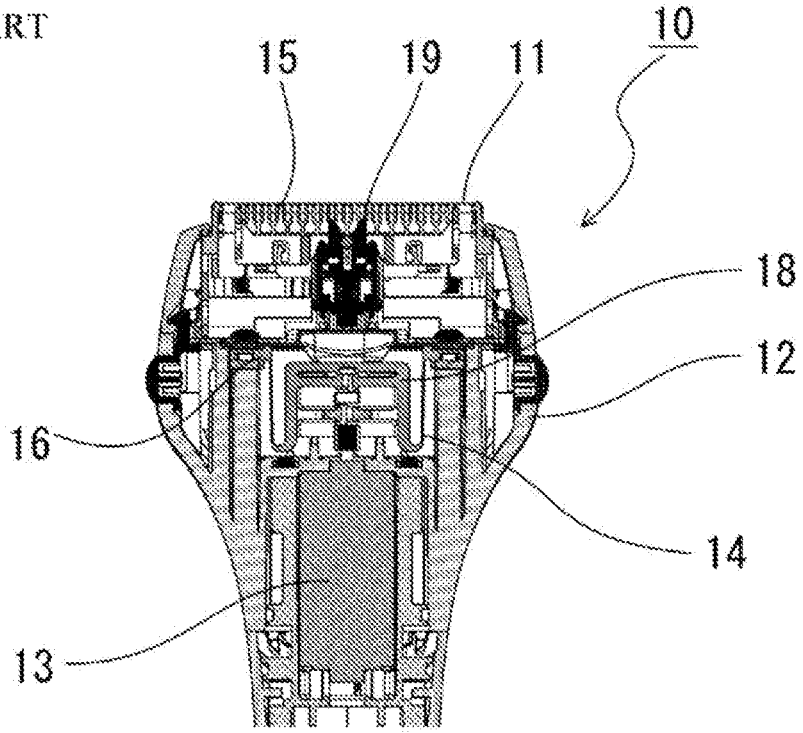
FIG.7 PRIOR ART
FIG. 7 is a sectional view illustrating an example of a reciprocating-type electric shaver in the related art.
Figure 8:
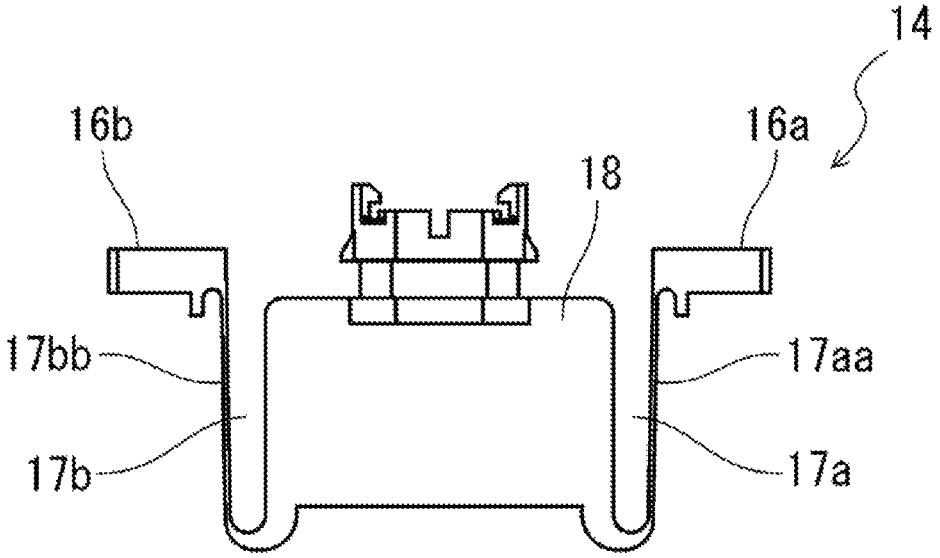
FIG.8 PRIOR ART
FIG. 8 is an illustrative view of an oscillator in the reciprocating-type electric shaver in the related art.
Figure 9:
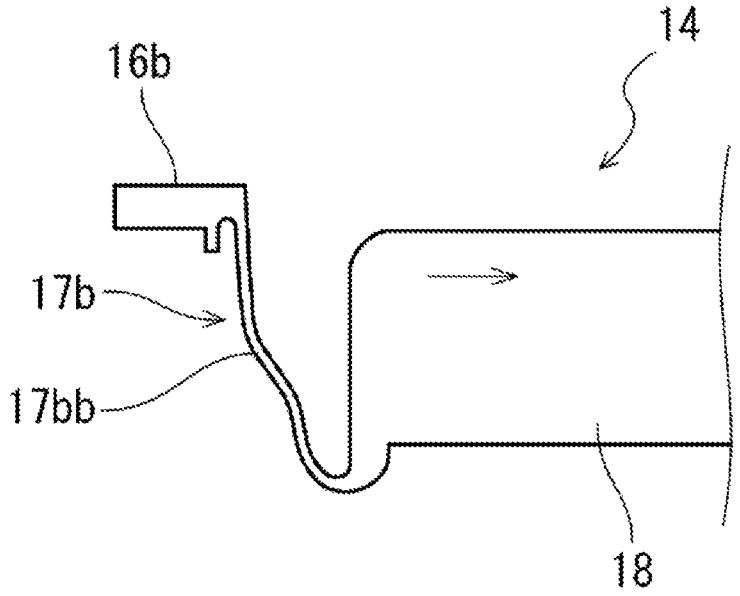
FIG.9 PRIOR ART
FIG. 9 is an illustrative view illustrating a waving phenomenon of the oscillating piece.
Figure 10:
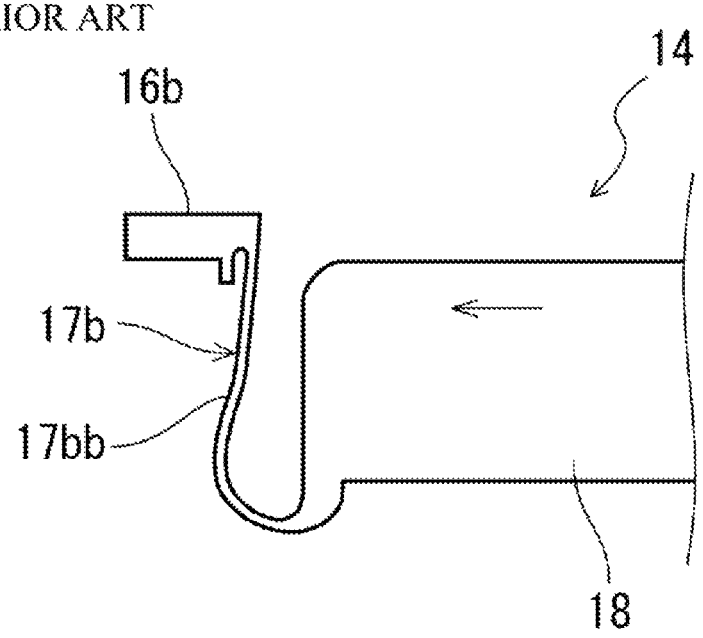
FIG.10 PRIOR ART
FIG. 10 is an illustrative view illustrating a waving phenomenon of the oscillating piece.

In an example illustrated in FIG. 6, the oscillating pieces 36*aa*, 36*bb* are disposed to be tilted in the direction X orthogonal to the reciprocating direction of the movable base 37 so that the lower portion side is open outward in the reciprocating direction of the movable base 37 at an angle of approximately 15°.

As mentioned above, the oscillating pieces 36*aa*, 36*bb* are formed to be tilting pieces the lower portion side of which are open outward in the reciprocating direction of the movable base 37 at the angles of approximately 0.5° to 15° in the direction X orthogonal to the reciprocating direction of the movable base 37. In this manner, even if the movable base 37 is caused to reciprocate at high speed of approximately 10,000 rpm, a waving phenomenon as in the related art no longer occurs in the oscillating pieces 36*aa*, 36*bb*.

The oscillating pieces 36*aa*, 36*bb* are formed to be the above-described tilting pieces. Accordingly, even when the oscillating pieces 36*aa*, 36*bb* return from the center of the movable base 37 at high speed or even when the oscillating pieces 36*aa*, 36*bb* move forward, a bending force is rarely applied to the oscillating pieces 36*aa*, 36*bb*. Therefore, it is considered that deformation (waving) of the oscillating pieces 36*aa*, 36*bb* is suppressed.

If the above-described tilting angle of the oscillating pieces 36*aa*, 36*bb* is smaller than 0.5°, the waving phenomenon of the oscillating pieces 36*aa*, 36*bb* cannot be satisfactorily suppressed.

In addition, if the above-described tilting angle of the oscillating pieces 36*aa*, 36*bb* is larger than 15°, resistance of the oscillating pieces 36*aa*, 36*bb* increases against the reciprocating movement of the movable base 37. Accordingly, it is not preferable to set the tilting angle larger than 15°.

At the stationary position of the movable base 37, it is preferable to set the tilting angle of the respective oscillating pieces 36*aa*, 36*bb* so that each outermost end of the respective oscillating pieces 36*aa*, 36*bb* is located outward from a position orthogonal to the reciprocating direction of the movable base 37 as far as a distance longer than ½ of a maximum reciprocating distance of the movable base 37.

Figure 11:
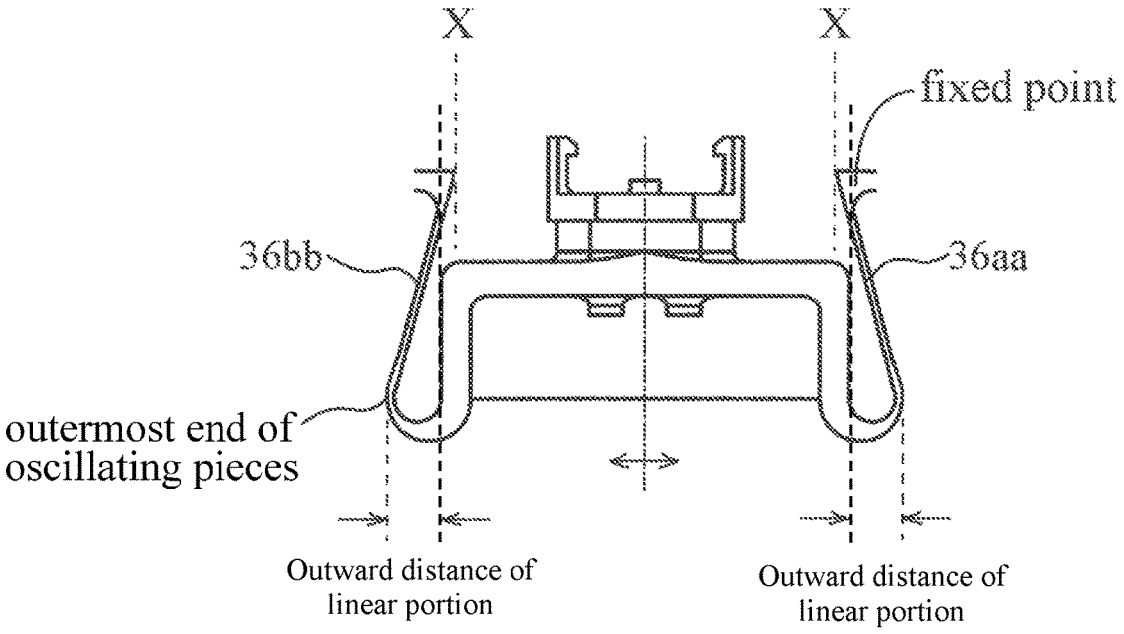
FIG. 11 is an illustrative view explaining a maximum reciprocating distance of the movable base of the oscillator.

That is, as shown in FIG. 11, if the maximum reciprocating distance of the movable base 37 is set to 2L, the movable base 37 moves to one side from the stationary position as far as L. Therefore, as described above, if at the stationary position of the movable base 37, the tilting angle of the respective oscillating pieces 36*aa*, 36*bb* is set so that the outermost end of the respective oscillating pieces 36*aa*, 36*bb* is located outward from the position orthogonal to the reciprocating direction of the movable base 37 as far as the distance longer than L which is ½ of the maximum reciprocating distance 2L of the movable base 37, even when the oscillating pieces 36*aa*, 36*bb* are located at a position where the movable base 37 is moved to the maximum, the oscillating pieces 36*aa*, 36*bb* are always located outward from the position orthogonal to the reciprocating direction of the movable base 37. Therefore, it is possible to reliably prevent the waving phenomenon of the oscillating pieces 36*aa*, 36*bb*.

As described above, according to the present embodiment, the waving phenomenon of the oscillating pieces 36*aa*, 36*bb* can be suppressed. Therefore, even in a case where the oscillating pieces 36*aa*, 36*bb* are rotated at high speed, durability of the oscillating pieces 36*aa*, 36*bb* can be maintained.

If the waving phenomenon occurs in the oscillating piece as in the related art, the movable base is minutely tilted. As a result, the inner blade is not allowed to linearly move in a front view, although the inner blade is slightly moved. According to the present embodiment, as described above, the waving phenomenon of the oscillating pieces 36*aa*, 36*bb* can be prevented, and the inner blade 34 moves satisfactorily and linearly. Accordingly, a phenomenon of unsymmetrical wear of the inner blade and the outer blade can be prevented. Therefore, there is an advantageous effect in that durability of the inner blade and the outer blade can be improved.

What is claimed is:

1. An electric shaver comprising:

an outer blade;

an oscillator that is driven to reciprocate in a reciprocating direction by a motor, the motor being installed inside a main body and an inner blade that reciprocates while coming into sliding contact with an inner surface of the outer bade in cooperation with the oscillator, wherein the oscillator includes:

a first attachment portion and a second attachment portion on respective end sides of the oscillator, and the first attachment portion and the second attachment portion being respectively attached to the main body, a movable base that is located between the first attachment portion and the second attachment portion in the reciprocating direction, the movable base having a first support portion and a second support portion disposed on respective end sides of the movable base and the movable base being supported by the first attachment portion and the second attachment portion via the first support portion and the second support portion, respectively, the first support portion including a first linear portion disposed on a first inner side of the oscillator, a second linear portion disposed on a first outer side of the oscillator, and a first curved portion connecting the first linear portion and the second linear portion at bottom ends of the first linear portion and the second linear portion, top ends of the first linear portion and the second linear portion being separated from each other to form a first opening towards the inner blade, the second linear portion of the first support portion being connected to the first attachment portion at a top section of the second linear portion, the first linear portion of the first support portion being connected to a corresponding one of the end sides of the movable base at a top section of the first linear portion, the second support portion including a third linear portion disposed on a second inner side of the oscillator, a fourth linear portion disposed on a second outer side of the oscillator, and a second curved portion connecting the third linear portion and the fourth linear portion at bottom ends of the third linear portion and the fourth linear portion, top ends of the third linear portion and the fourth linear portion being separated from each other to form a second opening towards the inner blade, the fourth linear portion of the second support portion being connected to the second attachment portion at a top section of the fourth linear portion, the third linear portion of the second support portion being connected to a corresponding one of the end sides of the movable base at a top section of the third linear portion, and the movable base being driven to reciprocate by the motor in a state of being suspended from the first attachment portion and the second attachment portion by the second linear portion and the fourth linear portion respectively, and a cooperation portion that protrudes from the movable base, and that cooperates with the inner blade, wherein the second linear portion of the first support portion and the fourth linear portion of the second support portion each form a respective flexible oscillating piece, and wherein at a stationary position of the movable base, the second linear portion of the first support portion is tilted with respect to a first virtual line, the first virtual line passing through the top end of the second linear portion and arranged orthogonal to the reciprocating direction, such that the bottom end of the second linear portion is located more outward, in the reciprocating direction, than the top end of the second linear portion with respect to the first virtual line, and the fourth linear portion of the second support portion is tilted with respect to a second virtual line, the second virtual line passing through the top end of the fourth linear portion and arranged orthogonal to the reciprocating direction, such that the bottom end of the fourth linear portion is located more outward, in the reciprocating direction, than the top end of the fourth linear portion with respect to the second virtual line.

2. The electric shaver according to claim 1, electric shaver according to claim 1, wherein at the stationary position of the movable base, a tilting angle of the second linear portion of the first support portion with respect to the first virtual line and a tilting angle of the fourth linear portion of the second support portion with respect to the second virtual line are within an angular range of 0.5° to 15°.

3. The electric shaver according to claim 1, electric shaver according to claim 1, wherein at the stationary position of the movable base, an outermost end of the second linear portion of the first support portion is located outward away from the first virtual line at a distance longer than ½ of a maximum reciprocating distance of the movable base, and an outermost end of the fourth linear portion of the second support portion is located outward away from the second virtual line at a distance longer than ½ of the maximum reciprocating distance of the movable base.

* * * * *